US006673004B2

(12) United States Patent
Nanba et al.

(10) Patent No.: US 6,673,004 B2
(45) Date of Patent: Jan. 6, 2004

(54) CUTTING AND FOLDING MECHANISM FOR A WEB-FED ROTARY PRESS

(75) Inventors: Takeo Nanba, Kanagawa (JP); Keiichiroh Ohta, Kanagawa (JP); Toshio Hasegawa, Kanagawa (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 10/147,870

(22) Filed: May 20, 2002

(65) Prior Publication Data

US 2003/0024412 A1 Feb. 6, 2003

(30) Foreign Application Priority Data

Jul. 18, 2001 (JP) ..... P2001-217625

(51) Int. Cl.[7] ..... B31F 1/10

(52) U.S. Cl. ..... 493/428; 493/424; 493/434; 493/435; 493/442

(58) Field of Search ..... 493/424, 428, 493/434, 435, 442

(56) References Cited

U.S. PATENT DOCUMENTS

| | | | | |
|---|---|---|---|---|
| 4,036,487 A | * | 7/1977 | Heimlicher et al. | 493/428 |
| 4,231,559 A | | 11/1980 | Weschenfelder et al. | |
| 4,445,881 A | * | 5/1984 | Bullen et al. | 493/424 |
| 4,490,132 A | * | 12/1984 | Ogura et al. | 493/424 |
| 4,778,166 A | * | 10/1988 | Nanba et al. | 270/47 |
| 5,242,367 A | * | 9/1993 | Marmin | 493/359 |
| 5,429,578 A | * | 7/1995 | Calbrix et al. | 493/359 |
| 6,165,118 A | * | 12/2000 | Eckert | 493/425 |
| 6,322,487 B1 | * | 11/2001 | Dufour | 493/424 |

FOREIGN PATENT DOCUMENTS

| | | |
|---|---|---|
| DE | 247009 | 5/1912 |
| DE | 623219 | 12/1935 |
| JP | S60-193365 | 12/1985 |
| JP | H02-055672 | 4/1990 |

OTHER PUBLICATIONS

European Search Report dated May 30, 2003.

* cited by examiner

*Primary Examiner*—Rinaldi I. Rada
*Assistant Examiner*—Gloria R Weeks
(74) *Attorney, Agent, or Firm*—Rader Fishman & Grauer

(57) ABSTRACT

A continuous web of printed paper is cut by a cutting cylinder into discrete sheets on being wrapped around part of a folding cylinder. The folding cylinder has sets of the folding blade in the cavity each aligned parallel to the cylinder axis and all arranged at constant circumferential spacings. Each folding blade is movable radially of the folding cylinder for pushing one sheet of printed paper off the cylinder surface in the middle of the sheet. Disposed opposite the folding cylinder, a jaw cylinder has cavities opening to its surface at constant circumferential spacings, each for receiving the midpart of the sheet being pushed by the folding blade in the cavity. Each cavity has a movable jaw arranged therein for pivotal motion toward and away from a fixed jaw in order to crease the sheet. An indentation is formed in the fixed jaw so as to be in opposed relationship to the insert part of the folding blade on the folding cylinder in the cavity as the folding blade is inserted in the cavity with the sheet.

8 Claims, 7 Drawing Sheets

CUTTING AND FOLDING MECHANISM FOR A WEB-FED ROTARY PRESS

BACKGROND OF THE INVENTION

1. Filed of the Invention

This invention relates to rotary presses, specifically to web-fed rotary presses, and more specifically to a mechanism in such machines for cutting the continuous web of printed paper into individual sheets and folding the successive sheets into sections or signatures. Still more specifically, the invention deals with improvements in or relating to the jaw cylinder and folding cylinder in the cutting and folding mechanism which coact to crease and fold the sheets.

2. Description of the Prior Art

The cutting and holding mechanism for a web-fed rotary press usually comprises a cutting cylinder in addition to the noted folding cylinder and jaw cylinder. The printed web of paper is first wrapped around part of the folding cylinder in constant rotation and, while being done so, cut into successive sheets by cutting blades on the cutting cylinder which cut the web and dig into counter cutting means on the folding cylinder. The folding cylinder is equipped with folding blades arranged at circumferential spacings on the surface thereof and each extending parallel to the axis of the folding cylinder. Each folding blade is movable radially of the folding cylinder for pushing each sheet into one of cavities formed in the surface of the jaw cylinder at circumferential spacing and each having an opening parallel to the axis of the jaw cylinder, the jaw cylinder being in rolling in close vicinity to the folding cylinder. Each sheet is folded and creased in one of the cavities in the jaw cylinder and thereby carried away from the folding cylinder.

A variety of suggestions have been made as to how to crease the sheet in each cavity in the jaw cylinder. Japanese Unexamined Utility Model Publication Nos. 2-55672 and 60-193365 are hereby cited. The first citation is alike in teaching use of a movable jaw in the form of a flat, elongate plate arranged in each cavity for movement toward and away from a fixed jaw, the latter being one of the pair of confronting walls defining the opening of the cavity. Pushed off the surface of the folding cylinder by one of the folding blades thereon, the sheet together with the folding blade is inserted in part in one of the cavities in the jaw cylinder and therein engaged between the fixed and movable jaws for creasing. Besides being actuated toward and away from the fixed jaw, the movable jaw is sprung to a certain extent toward the fixed jaw to allow for differences in the thickness of sections to be handled and to close the space created in the folded sheet upon withdrawal of the folding blade therefrom.

Japanese Unexamined Utility Model Publication No. 2-55672 differs from the other reference in that either or both of the fixed and movable jaws are stepped to release the extreme edge of the creased sheet from being engaged therebetween. As the folding blade withdraws into the folding cylinder from the cavity in the jaw cylinder following the engagement of the sheet between the fixed and movable jaws, the space created in the folded portion of the sheet is closed by the movable jaw under spring pressure. Thus is the folded sheet creased between the pair of jaws, only with the extreme edge of the fold left unengaged by the stepped jaw or jaws.

An objection to this first prior art device is that when inserted in the cavity by and with the folding blade, the sheet was inserted between, in particular, the folding blade and the fixed jaw throughout its length along the axis of the jaw cylinder, being strongly pressed against them. The sheet was therefore wedged and ironed by the blade and the folding jaw, with the consequent smearing of the printed sheet surfaces superimposed and contacted with each other, by ink offset. Such ink offset was all the more easy to occur because not only the folded sheet but the folding blade too is first caught between the fixed and movable jaws. The sheet is then under greater spring pressure from the movable jaw than when the folding blade is not caught between the jaws.

Japanese Unexamined Utility Model Publication No. 60-193365, on the other hand, adopts, in addition to the fixed and movable jaws, spring-loaded pushpins extending through the movable jaw for pushing the inserted sheet against abutments of polyurethane or like elastic material on the fixed jaw. Each folding blade on the folding cylinder is recessed to permit the pushpins to travel therethrough. The movable jaw is itself also sprung toward the fixed jaw for the same reasons as that of the first cited reference is. The sheet that has been pushed into the cavity is engaged not only between the fixed and movable jaws but, additionally, between the pushpins and the elastic abutments, in order to remain inserted in the cavity during the withdrawal of the folding blade from between the pair of jaws.

Folded upon forced insertion in the cavity in the jaw cylinder by the folding blade on the folding cylinder, the sheet as well as the folding blade is captured between the fixed and movable jaws. Furthermore, only the folded sheet between the these jaws is pressed against the elastic abutments on the fixed jaw by the spring-loaded pushpins. Upon subsequent withdrawal of the folding blade from the cavity, the space thereby created between the folded parts of the sheet is closed by the spring-loaded movable jaw. The sheet is creased by being pressed against the fixed jaw by the movable jaw, besides being urged against the elastic abutments by the pushpins.

This second prior art folding mechanism possesses the same problems concerning ink offset as does the first. Ink offset was particularly prone to occur at the portion of the folded sheet pressed against the elastic abutments on the fixed jaw by the spring-loaded pushpins. These pushpins themselves gave rise to some additional difficulties. First, being left protruding from the movable jaw under spring pressure, the pushpins were liable to be hit by the sheet being pushed into the cavity, with consequent damage to the sheet. Second, the pushpins on being sprung against the abutment via the sheet were easy to create dents in the sheet surface.

These difficulties arising from the spring-loaded pushpins are absent, of course, from the first cited prior art device. But then the sheet that has been creased between the jaws was easy to come out the cavity together with the folding blade upon withdrawal of the latter, resulting in total failure in folding the sheet.

SUMMARY OF THE INVENTION

The present invention has it as an object to preclude the trouble, heretofore often encountered in the art, of any undesired ink offset and consequent smearing of the sheets during the insertion of each sheet in the cavity in the jaw cylinder by the folding blade on the folding cylinder, during the forced engagement of the sheet between the fixed and movable jaws, and during the withdrawal of the folding blade from between the jaws.

Another object of the invention is to assure smooth withdrawal of the folding blade from between the fixed and movable jaws without the inconveniences of the concurrent withdrawal or other displacement or disarrangement of the sheet.

Briefly, the present invention may be summarized as a mechanism in a web-fed rotary press for cutting a continuous web of paper into discrete sheets and folding the successive sheets in the middle into the form of signatures. The cutting and folding mechanism comprises a cutting cylinder, a folding cylinder, and a jaw cylinder. The cutting cylinder has a cutting blade which is to be received, with the rotation of the cutting cylinder and the folding cylinder in opposite directions, on a counter cutting means disposed on the peripheral surface of the folding cylinder for cutting the web into successive sheets. The folding cylinder has means such as set of retractable piercing pins for holding each sheet in place on the folding cylinder by the time when the sheet is thereby transported to a position opposite the jaw cylinder, and folding blades arranged parallel to the folding cylinder axis for travel radially of the folding cylinder in order to push each sheet off the surface of the folding cylinder in the middle of the sheet.

The jaw cylinder, to which the invention specifically pertains, has opened in its surface a cavity for receiving the midpart of the sheet that has been pushed as above by the folding blade. Arranged in the cavity, a movable jaw is movable toward and away from a fixed jaw, which is one of the confronting walls parallel to the jaw cylinder axis and defining an opening of the cavity, in order to press the sheet against the fixed jaw for creasing. The fixed jaw has an indentation formed in its surface so as to be in opposed relationship to an insert part of the folding blade on the folding cylinder in the cavity as the folding blade is inserted in the cavity together with the sheet being pushed thereby.

The movable jaw is held retracted from the fixed jaw before insertion of the sheet in the cavity. When pushed into the cavity by the part of folding blade to be inserted in the cavity, the sheet is not pressed hard against the fixed jaw and not ironed since the latter has the indentation formed therein opposite the insert part of folding blade in the cavity. The sheet is not to pressed hard against the fixed jaw and not ironed, because the unindented part of the fixed jaw is opposed to the spacing rather than the insert part of folding blade in the cavity. The sheet is not ruined and the printed surfaces thereof folded, superimposed and contacted each other are therefore not to ink-smeared by unnecessarily forced sliding contact with the fixed jaw and hence to hold the printings thereon unimpaired.

The movable jaw driven toward the fixed jaw with one of the opposed parts of the sheet folded in the midpart is required to move toward the fixed jaw only to an extent necessary to remove the gaps between the insert part of the folding blade in the midpart of the sheet and the part of the sheet opposed thereto. The other part of the sheet are not pressed too hard, either, because they are caught between the fixed and the movable jaw without interposition of the folding blade therebetween. No ink off-set is therefore bound to occur following the engagement of the sheet between the two jaws.

Upon subsequent withdrawal of the folding blade in the cavity from between the opposed parts of the folded midpart of the sheet back into the folding cylinder, the sheet being creased and folded into a signature is held fast between the fixed and the movable jaw. The folding blade will be easy of disengagement from between the folded midpart of the sheet because the insert part of the folding blade has not been caught too hard by the sheet thanks to the indentation in the fixed jaw. There is practically no possibility of the sheet being pulled out the cavity by the withdrawing the folding blade, not either in part or in whole.

Preferably, as in the preferred embodiment to be presented subsequently, the movable jaw may also have an indentation formed in its surface opposite the fixed jaw. Like the fixed jaw indentation, the movable jaw indentation should be placed in opposed relationship to the insert part of the folding blade on the folding cylinder as the folding blade is inserted in the cavity in the jaw cylinder. The sheet will then be not pressed hard against the insert part of folding blade in the cavity when the indented movable jaw is made to move toward the fixed jaw for creasing the sheet, with the consequent reduction of the possibility of ink offset between printed surfaces of the sheet contacted each other. As an additional advantage the folding blade will subsequently withdraw from between the folded sheets even more smoothly and without displacing or disarranging the sheet in so doing.

The above and other objects, features and advantages of this invention will become more apparent, and the invention itself will best be understood, from a study of the following description and appended claims, with reference had to the attached drawings showing the preferred embodiments of the invention.

DESCRIPTION OF THE PREFERRED EMBODIMENT

General

How the continuous, printed web of paper is cut into sheet form, and each sheet subsequently folded into a signature, will become apparent from a consideration of FIG. 1. Three parallel cylinders are herein shown, the cutting cylinder 1, the folding cylinder 2, and the jaw cylinder 3. The cutting cylinder 1 is in constant rotation in a prescribed direction, which is counterclockwise as viewed in this figure. Somewhat spaced from the cutting cylinder 1, the folding cylinder 2 is in constant rotation in a clockwise direction as viewed in this figure. The web W of printed paper travels by being wrapped around part of the surface of the folding cylinder 2 and, while riding on the folding cylinder, is cut successively into sheets $W_1$ by the cutting cylinder 1.

Figure 1:
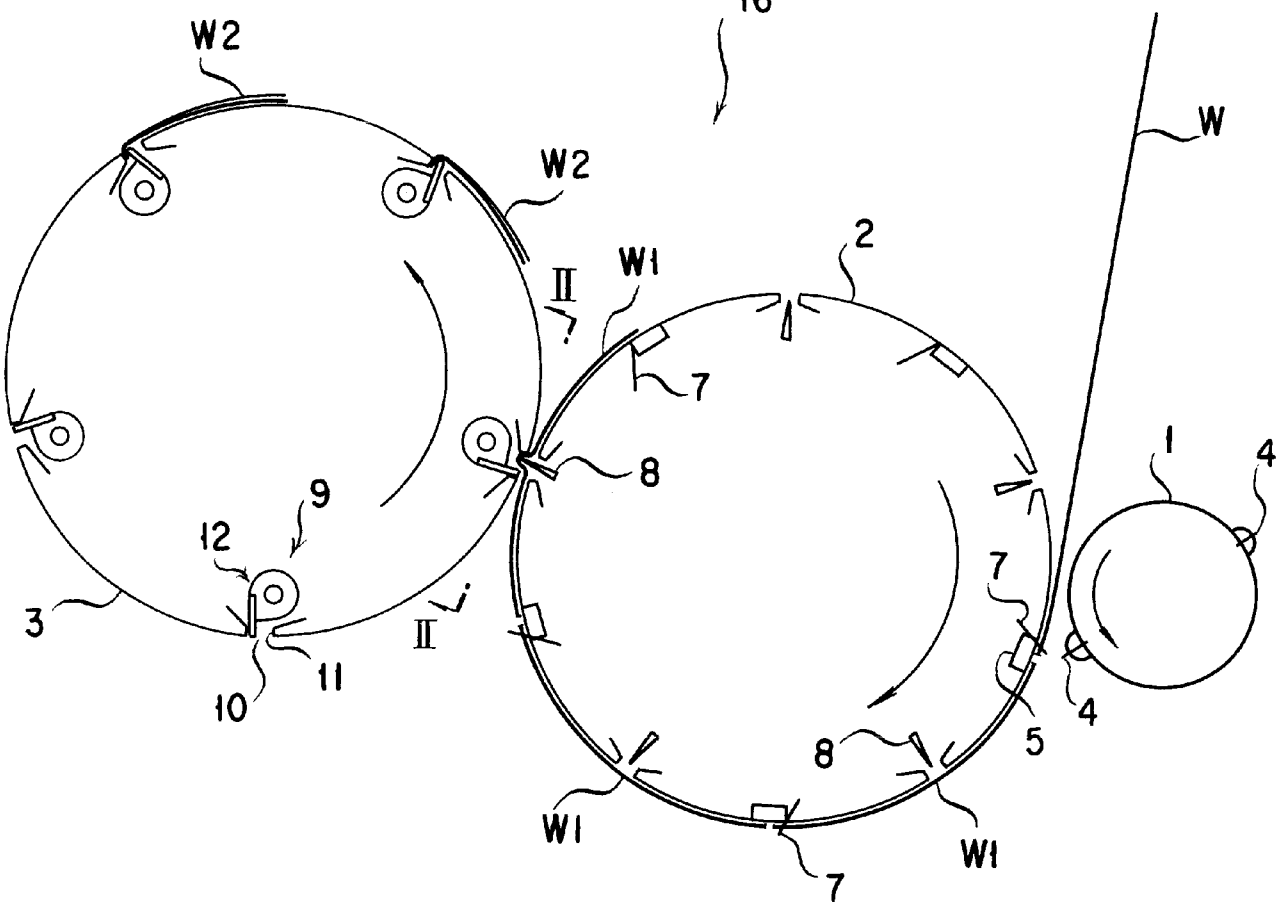
FIG. 1 is a diagrammatic illustration of three cylinders making up a cutting and folding mechanism of a web-fed rotary press, the cylinders being shown together with various means built into them.

Held opposite the folding cylinder 2, the jaw cylinder 3 rotates counterclockwise in FIG. 1. A plurality of cavities are cut in the surface of the jaw cylinder 3 at constant circumferential spacings for receiving the midportions of the individual sheets $W_1$ as they are pushed off the folding cylinder. A pair of jaws are provided within each cavity for catching the midpart of the sheet that has been inserted therein. Caught by the jaws in each cavity in the jaw cylinder 3, the sheet $W_1$ is to be pulled off the surface of the folding cylinder 2 with the continued rotation of the two cylinders 2 and 3 in opposite directions, thereby to be folded into a signature $W_2$ on the jaw cylinder.

Hereinafter in this specification the noted cutting cylinder 1, folding cylinder 2, and jaw cylinder 3, inclusive of the various means built into these cylinders, will be discussed in more detail, in that order and under separate headings. A comprehensive operational description of the folding mechanism will follow the discussion of the individual cylinders.

Cutting Cylinder

With continued reference to FIG. 1 the cutting cylinder 1 has one or more, two in this particular embodiment, cutting blades 4 in diametrically opposite positions on its surface. Each cutting blade 4 extends parallel to the axis of the cutting cylinder 1 substantially throughout its length. The cutting cylinder 1 coacts with the folding cylinder 2, in a manner yet to be described, to cut the continuous web W of printed paper into a sheet $W_1$ with every 180-degree rotation of the cutting cylinder.

Folding Cylinder

As shown also in FIG. 1, the folding cylinder 2 is much greater in diameter than the cutting cylinder 1 and has a plurality of, five in this particular embodiment, counter cutting bars 5 disposed longitudinally in its surface at constant circumferential spacings. The circumferential distance between these counter cutting bars in the folding cylinder 2 is the same as that between the cutting blades 4 on the cutting cylinder 1. Further the two cylinders 1 and 2 are positioned in predetermined angular relationship to each other, and driven in opposite directions at the same circumferential velocity, in order that the two cutting blades 4 on the cutting cylinder may be alternately received on the successive counter cutting bars 5 in the folding cylinder. Thus is the web W cut successively into the sheets $W_1$ of prescribed length on the folding cylinder 2.

The folding cylinder 2 has sets of piercing pins 7 projecting from its surface. Each set of piercing pins 7 are arranged in a row parallel to the cylinder axis in a position just upstream of each counter cutting bar 5 with respect to the arrow-marked rotational direction of the folding cylinder 2. As there are five counter cutting bars 5 in the illustrated embodiment, so there are as many such sets of piercing pins 7. Angled somewhat downstream of the folding cylinder 2 with respect to its rotational direction as they extend radially outwardly of the cylinder, the piercing pins 7 are designed to pierce the web W as the latter is wrapped around the folding cylinder. Since the web W is pierced by the pins 7 at the leading ends of the successive sheets $W_1$ into which it is cut, these sheets are to be carried over to the position opposite the jaw cylinder 3 without the likelihood of falling off the folding cylinder 2 on being cut.

The folding cylinder 2 has also mounted therein a plurality of, five in the illustrated embodiment, folding blades 8 each extending parallel to the cylinder axis and all arranged at constant circumferential spacings. Each folding blade 8 is positioned in the middle of two neighboring counter cutting bars 5.

Figure 2:
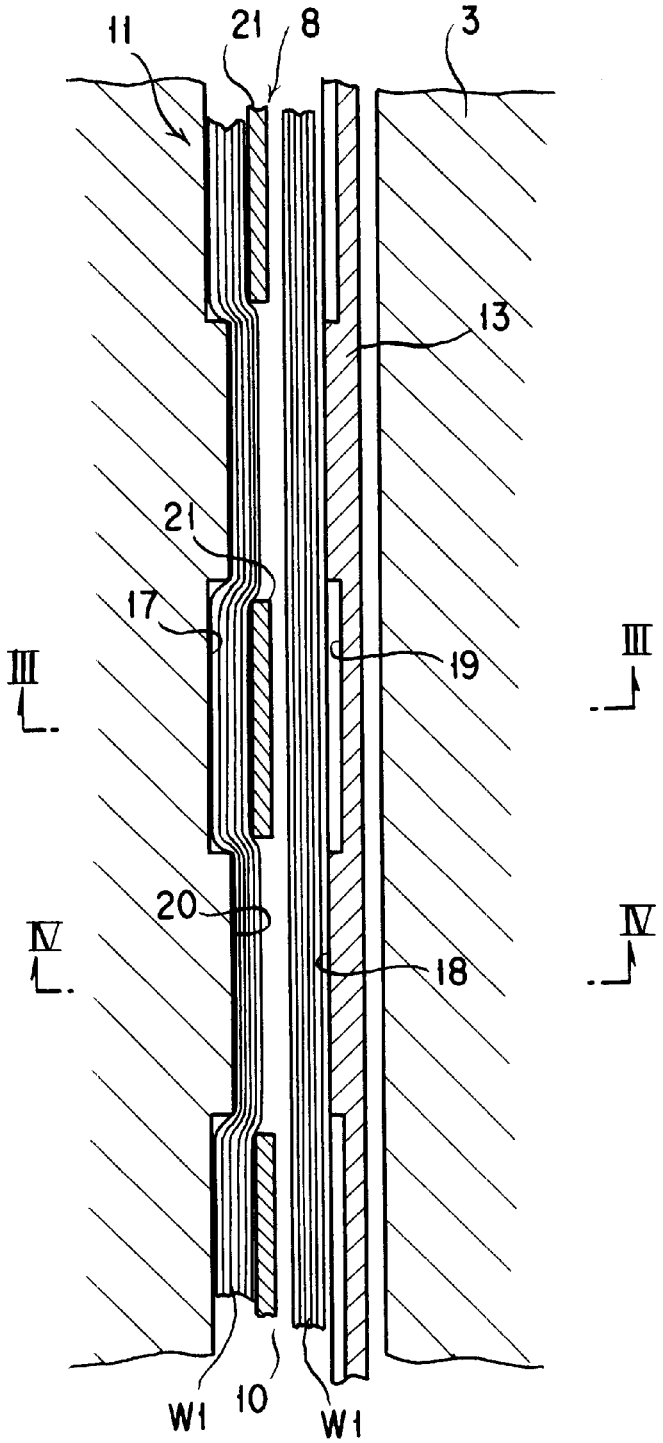
FIG. 2 is an enlarged, fragmentary section through the jaw cylinder of the FIG. 1 cutting and folding mechanism which is taken along the line II—II in FIG. 1, the view showing the fixed jaw and movable jaw constructed according to the present invention, together with a sheet that has been pushed into a cavity in the jaw cylinder by properly spaced-apart and insert parts of a folding blade on a folding cylinder in the cavity, the movable jaw being shown retracted away from the fixed jaw.

As pictured on an enlarged scale in FIG. 2, which depicts a section taken along the line II—II in FIG. 1, each folding blade 8 has properly spaced-apart, flat parts 21 to be inserted in the cavity. Each series of parts 21 of the folding blade to be inserted in the cavity are jointly movable, by means that are not shown because of their conventional nature, radially of the folding cylinder 2 for pushing one sheet $W_1$ off the surface of the folding cylinder in the middle of the sheet.

Jaw Cylinder

FIG. 1 indicates that the jaw cylinder 3 is of the same diameter as the folding cylinder 2 and has cut in its surface five cavities 10 each extending parallel to the cylinder axis and all arranged at constant circumferential spacings. The folding cylinder 2 and jaw cylinder 3 are so angularly positioned with respect to each other that the successive folding blades 8 on the folding cylinder come exactly opposite the successive cavities 10 in the jaw cylinder as the two cylinders rotate at the same speed in opposite directions. On coming to the position opposite one cavity 10, each folding blade 8 is to be thrust radially outwardly of the folding cylinder 2 for pushing the midpart of one sheet $W_1$ off the surface of the folding cylinder and into the cavity.

Figure 3:
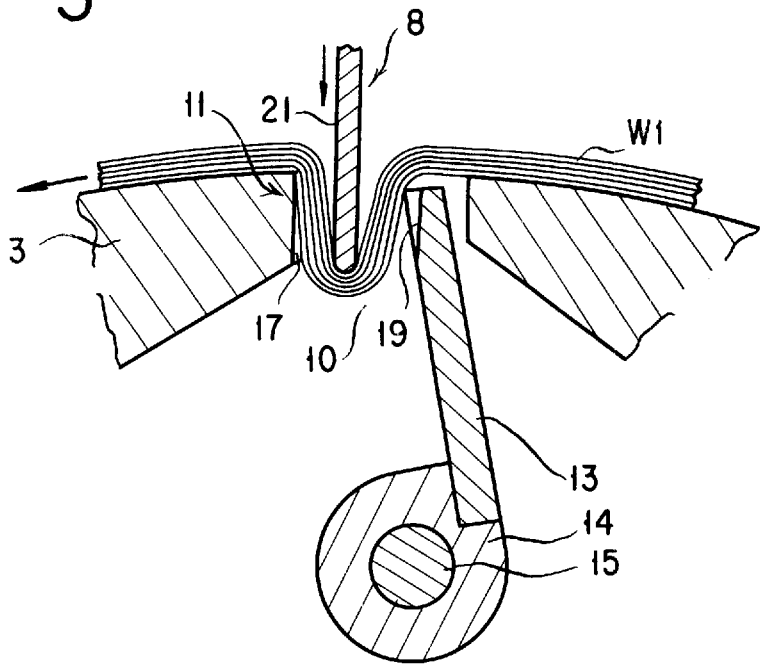
FIG. 3 is a section taken along the line III—III in FIG. 2 and showing one of the properly spaced-apart and insert parts of the folding blade between one indentation in the fixed jaw and one indentation in the movable jaw.
Figure 4:
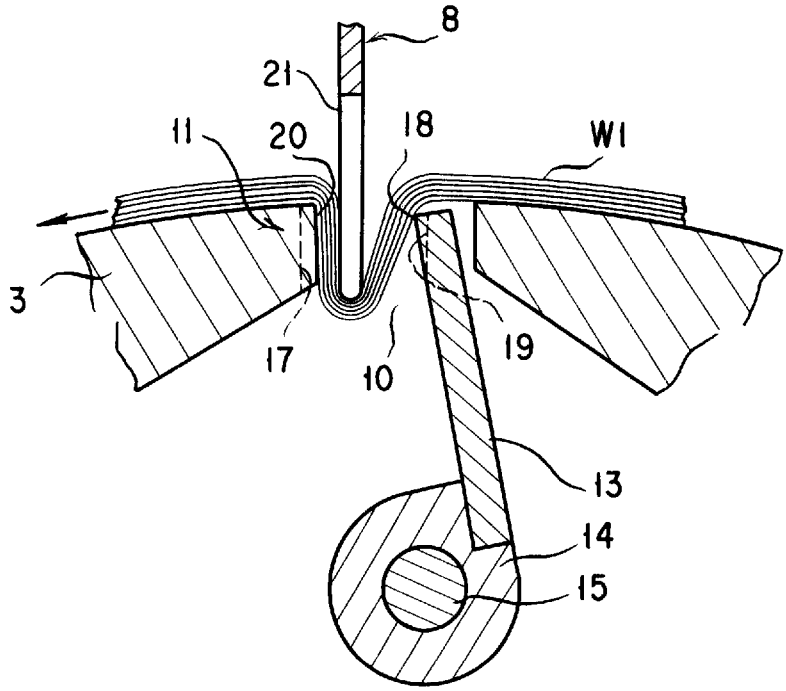
FIG. 4 is a section taken along the line IV—IV in FIG. 2 and showing an unindented part of the fixed jaw and an unindented part of the movable jaw, between which there is a space between the insert parts of the folding blade in the cavity.

Arranged in each cavity 10 in the jaw cylinder 3 is a movable jaw 13 seen in FIG. 2, as well as in FIGS. 3 and 4 which are sectional views taken along the lines III—III and IV—IV in FIG. 2. The movable jaw 13 is a relatively thin, elongate strip extending throughout the length of the cavity 10 and mounted fast to an angularly displaceable shaft 15 via a set of fixtures 14 along one longitudinal edge thereof. Therefore, with the bidirectional angular displacement of the shaft 15 relative to the jaw cylinder 3 through a limited angle, the movable jaw 13 is pivotable toward a fixed jaw 11 for catching the midpart of the sheet W1 as the latter is inserted between the jaws 11 and 13 by the insert parts 21 of the folding blade on the folding cylinder 2 in the cavity. The fixed jaw 11 is integrated with the downstream side wall of the cavity 10 with respect to the predetermined rotational direction of the jaw cylinder 3 indicated by the arrows in FIGS. 3 and 4.

It is understood that the shaft 15 is received in each cavity 10 in the jaw cylinder 3, with its opposite ends pivotaly journaled in bearings, not shown, on the jaw cylinder. Means for causing the required forced angular motion of the movable jaw 13 toward the fixed jaw 11 can be conventional and not shown. Suffice it to say, therefore, that the shaft 15 has an extension which projects from one end of the jaw cylinder 3 and which has a radial arm carrying a cam follower roll for operable engagement with a fixed cam.

FIG. 2 best reveals spaced-apart indentations or depressions 17 cut in the surface of the fixed jaw 11. The indentations 17 alternate with nonindentations 20 of the fixed jaw surface in a direction parallel to the axis of the jaw cylinder 3. Upon insertion of the properly spaced-apart parts 21 of the folding blade on the folding cylinder 2 into the cavity 10, as portrayed in FIG. 2, these insert parts of the folding blade in the cavity come into confronting relationship to the fixed jaw indentations 17, with the spaces between the insert parts of the folding blade opposed to the fixed jaw nonindentations 20. The dimension of each fixed jaw indentation 17 in a direction parallel to the jaw cylinder axis is greater than the dimension of each insert parts 21 of the folding blade in the same direction, and the dimension of each fixed jaw nonindentations 20 in the same direction is accordingly less than the spacing between the insert parts of the folding blade in the cavity.

The movable jaw 13 is also shown to have spaced-apart indentations 19, each with a sloping bottom, cut its surface directed toward the fixed jaw 11 and in the immediate vicinity of its free edge. These movable jaw indentations 19 alternate with movable jaw nonindentations 18 in the direction parallel to the axis of the jaw cylinder 3. The dimensions of each movable jaw nonindentations 18 and each movable jaw indentation 19 in the direction parallel to the axis of the jaw cylinder 3 are approximately the same as the corresponding dimensions of each fixed jaw indentation 17 and each fixed jaw nonindentations 20, respectively. Further the movable jaw nonindentations 18 are disposed opposite the fixed jaw nonindentations 20, and the movable jaw indentations 19 opposite the fixed jaw indentations 17.

Operation

The cutting cylinder 1, folding cylinder 2, and jaw cylinder 3 are all to rotate at the same circumferential speed matching the rate at which the web W of printed paper issues from the unshown printing station of the rotary press. Pierced by the successive circumferentially spaced sets of pins 7 on the folding cylinder 2, the web W will travel, accompanying the folding cylinder, after being cut into discrete sheets $W_1$ by the cutting blades 4 on the cutting cylinder 1 in positions just downstream of the pins 7 with respect to the rotational direction of the folding cylinder 2.

In the illustrated embodiment of the invention the web W is pierced by one set of pins 7 with every one fifth of each complete revolution of the folding cylinder 2 and cut off into one discrete sheet $W_1$ as one cutting blade 4 on the cutting cylinder 1 is received on one counter cutting bar 5 in the folding cylinder. FIG. 1 shows three such sheets $W_1$ of printed paper being carried in a row on the folding cylinder. The leading one of these three sheets $W_1$ is now shown positioned opposite the jaw cylinder 3, ready to have its midpart pushed into one of the cavities 10 in the jaw cylinder by the folding blade 8 on the folding cylinder 2. Then the set of piercing pins 7 that have been engaged with this leading sheet $W_1$ will be withdrawn into the folding cylinder 2 out of engagement with the sheet. Concurrently, the folding blade 8 associated with the leading sheet $W_1$ will be thrust radially outwardly of the folding cylinder thereby pushing the midpart of the leading sheet $W_1$ into the cavity 10 in the jaw cylinder 3.

It is understood that in the cavity in the jaw cylinder 3, the movable jaw 13 has been held away from the fixed jaw 11 as in FIGS. 2–4. Therefore, pushed by the folding blade 8 as above, the leading sheet $W_1$ will have its midpart somewhat loosely received between fixed jaw 11 and movable jaw 13, together with the parts 21 of the folding blade to be inserted in the cavity. FIG. 2 is illustrative of the state of the sheet WI that has been loosely received as above between the pair of jaws 11 and 13. FIG. 3 shows, in particular, the state of the sheet $W_1$ in relation to the insert parts 21 of the folding blade in the cavity, the indentations 17 in the fixed jaw 11, and the sloping-bottom indentations 19 in the movable jaw 13. FIG. 4 shows the state of the sheet $W_1$ in relation to the spacings between the insert parts 21 of the folding blade in the cavity, the nonindentations 20 on the surface of the fixed jaw 11, and the nonindentations 18 on the surface of the movable jaw 13.

Figure 5:
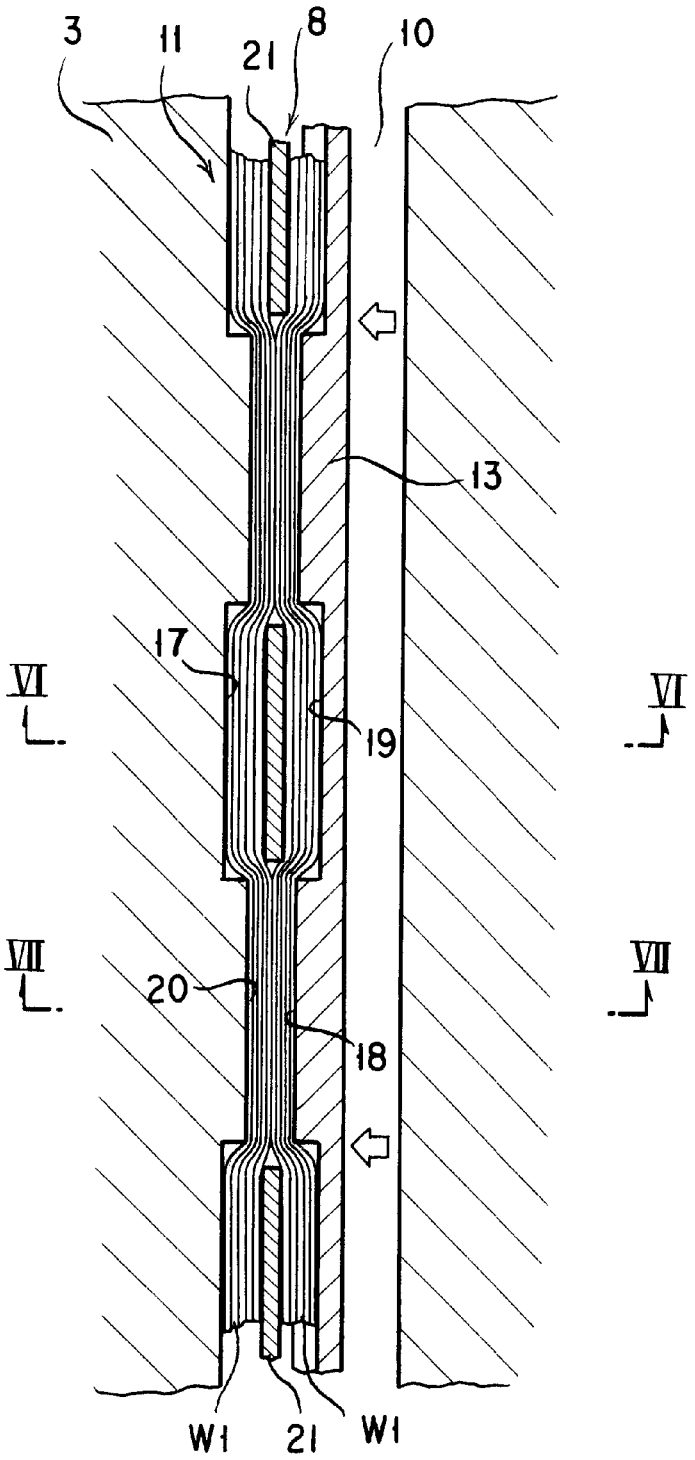
FIG. 5 is a view similar to FIG. 2 except that the movable jaw is shown urged toward the fixed jaw to catch the sheet in coaction therewith, with the insert parts of the folding blade in the cavity left inserted therebetween.
Figure 6:
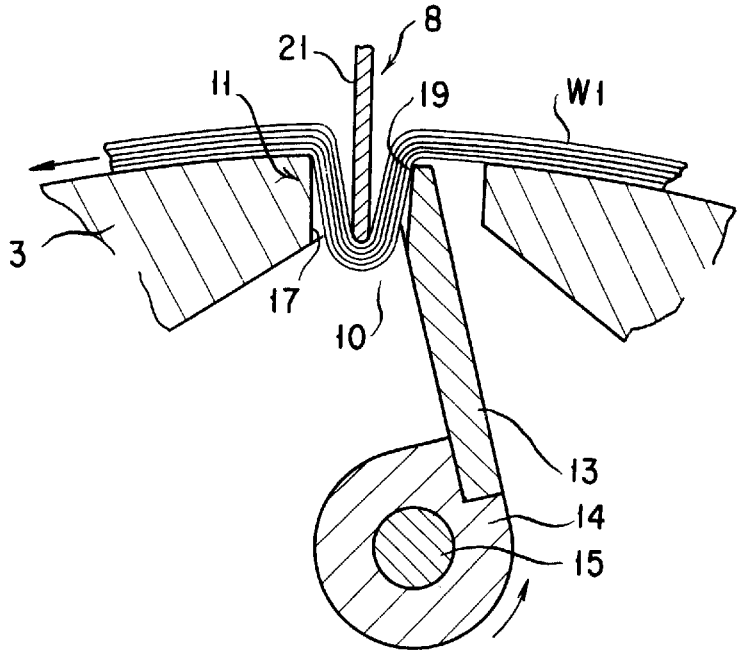
FIG. 6 is a section taken along the line VI—VI in FIG. 5 and showing the sheet being engaged between one indentation in the fixed jaw and one indentation in the movable jaw.
Figure 7:
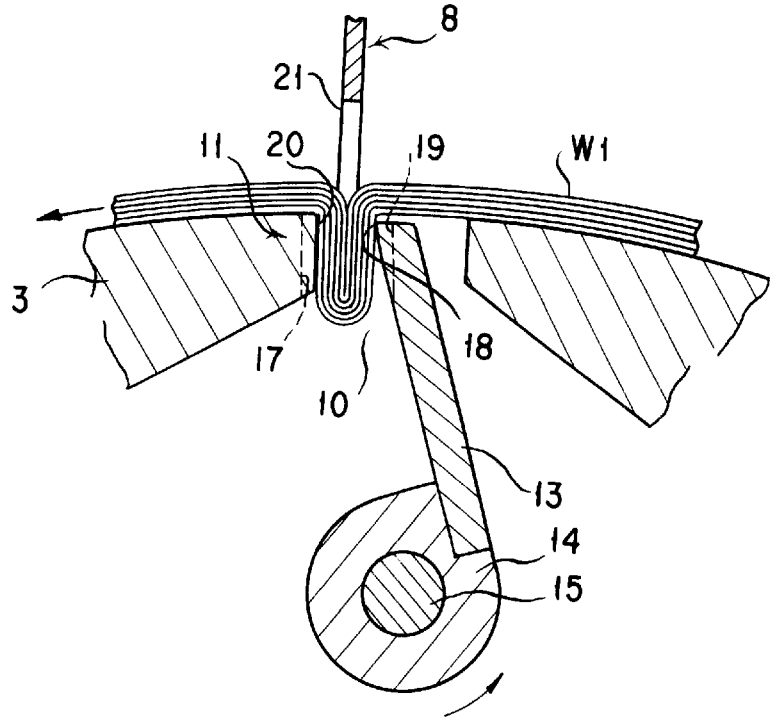
FIG. 7 is a section taken along the line VII—VII in FIG. 5 and showing the midpart of the sheet being caught between an unindented part of the fixed jaw and an unindented part of the movable jaw.

In FIGS. 5–7 is shown the movable jaw 13 subsequently pivoted toward the fixed jaw 11 for catching the sheet $W_1$, with the insert parts 21 of the folding blade in the cavity, however, still pushing the sheet $W_1$ into the cavity. It will be observed from these figures that the sheet $W_1$ is pressed harder between movable jaw nonindentations 18 and fixed jaw nonindentations 10 than between movable jaw indentations 19 and fixed jaw indentations 17 despite the presence of the insert parts 21 of the folding blade between the indentations 17 and 19.

Figure 8:
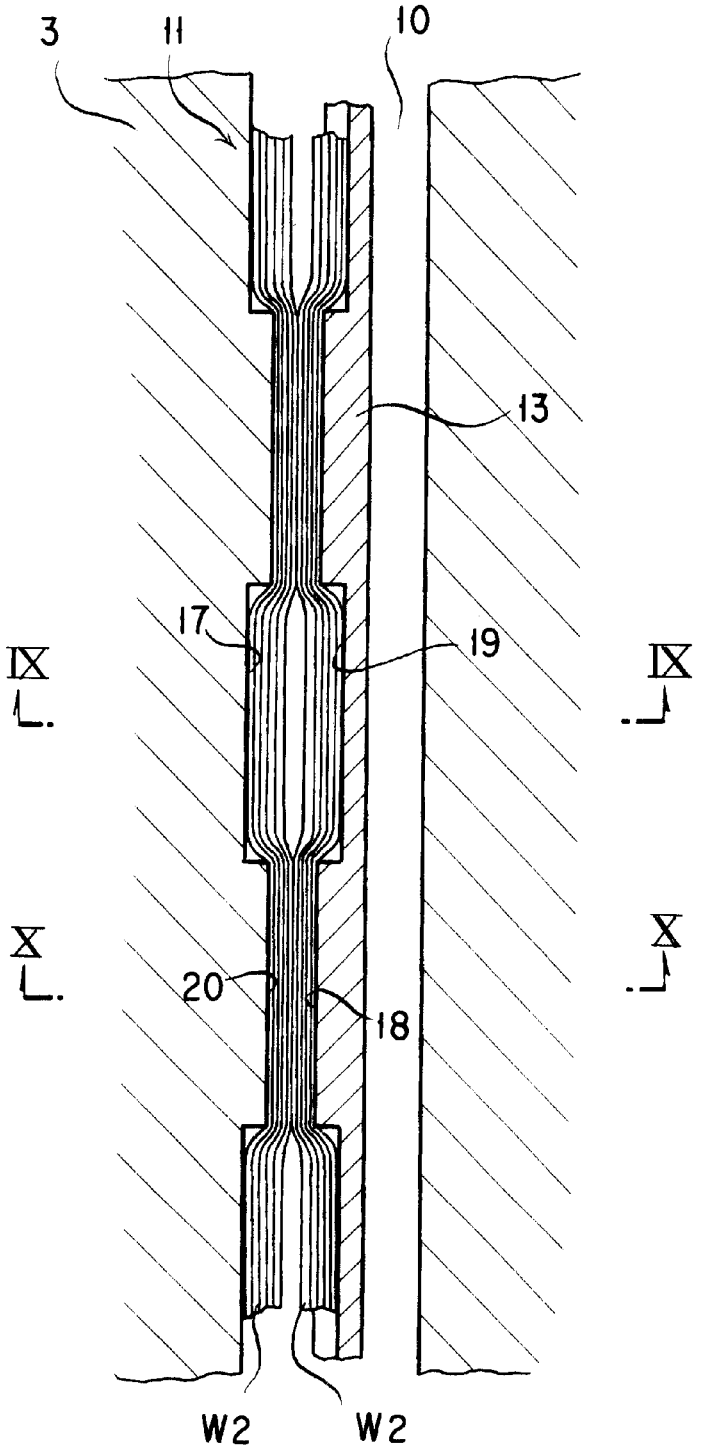
FIG. 8 is a view similar to FIG. 2 except that the insert parts of the folding blade in the cavity are not shown, having been withdrawn from between the jaws.
Figure 9:
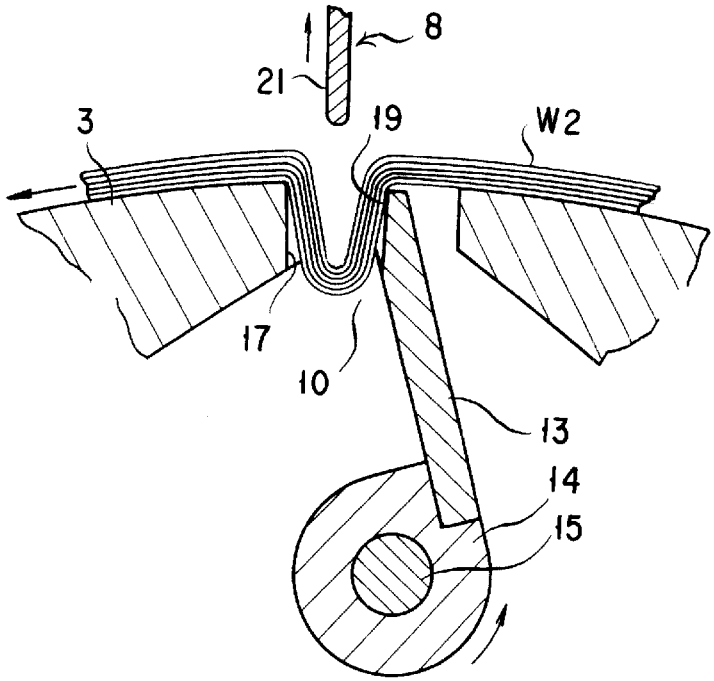
FIG. 9 is a section taken along the line IX—IX in FIG. 8 and showing the sheet caught between one indentation in the fixed jaw and one indentation in the movable jaw after the folding blade is withdrawn from the cavity.
Figure 10:
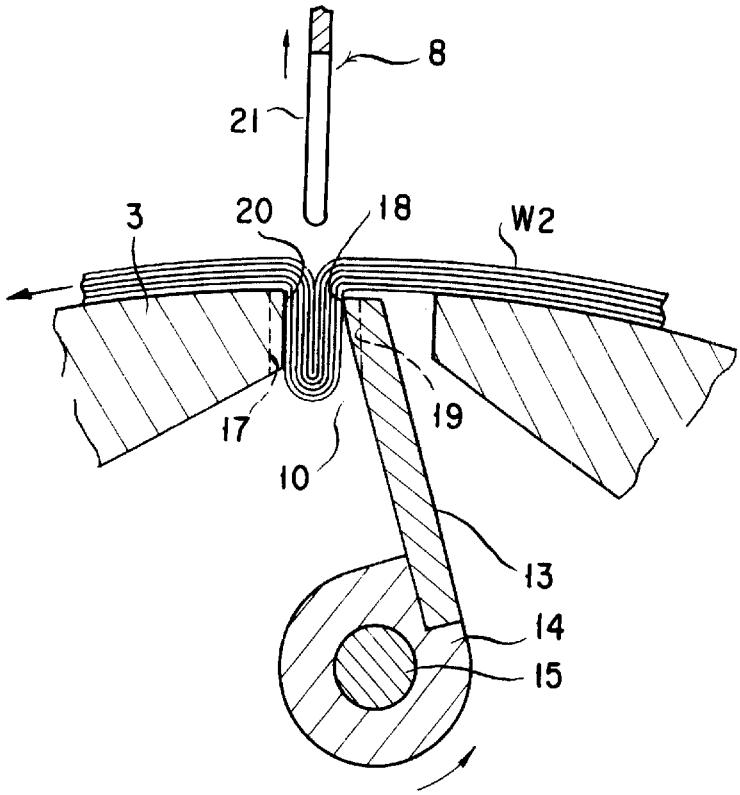
FIG. 10 is a section taken along the line X—X in FIG. 8 and showing the sheet caught between an unindented part of the fixed jaw and an unindented part of the movable jaw after the folding blade is withdrawn from the cavity.

Then insert parts 21 of the folding blade in the cavity are to be withdrawn from between the sheets $W_1$ caught and superimposed back into the folding cylinder 2. FIGS. 8–10 show the resulting state of the sheet $W_1$ between the pair of jaws 11 and 13. The catching of the sheet $W_1$ has now been completed. The sheet $W_1$ will be thoroughly folded into the form of a signature $W_2$, FIG. 1, by being carried by the jaw cylinder 3 away from the folding cylinder 2, with its midpart held engaged between the pair of jaws 11 and 13.

It is noteworthy in connection with FIG. 2 that when the sheet $W_1$ is pushed into the cavity 10 by the parts 21 of the folding blade to be inserted in the cavity as in this figure, the parts of the sheet which are under direct pressure from the insert parts of the folding blade in the cavity are not to rub hard against the fixed jaw 11 thanks to greater space existing between the insert parts of the folding blade in the cavity and the fixed jaw due to the creation of the fixed jaw indentations 17 in opposed relationship to the insert parts 21 of the folding blade in the cavity. The other parts of the sheet, which are contacting with the fixed jaw nonindentations 20, are not to rub hard against the fixed jaw surfaces, either, because they are opposed to the spacings between the insert parts of the folding blade in the cavity and are therefore not wedged between the insert parts of the folding blade in the cavity and the fixed jaw. Thus, as a whole, there is little or no likelihood of the sheet $W_1$ being smeared or ruined by forced rubbing against the fixed jaw 11.

After having been engaged between the pair of jaws 11 and 13 as in FIGS. 5–7, the sheet $W_1$ is pressed between fixed jaw indentations 17 and movable jaw indentations 19 only to an extent necessary to eliminate the gaps between the insert parts 21 of the folding blade in the cavity and the sheet. The sheet is caught between fixed jaw nonindentations 20 and movable jaw nonindentations 18 in order not to drop. Since the parts 21 of the folding blade to be inserted in the cavity are not inserted between these fixed and movable jaw nonindentations 18 and 20, the sheet is not pressed so hard as if, as has been the conventional case heretofore, the folding blade were caught therebetween for subsequent withdrawal. The sheet $W_1$ is therefore not to be stained or otherwise impaired after being engaged between the pair of jaws 11 and 13, either.

The sheet $W_1$ can nevertheless be held tight enough not to drop between movable jaw nonindentations 18 and fixed jaw nonindentations 20 as the insert parts 21 of the folding blade in the cavity are subsequently withdrawn from the cavity 10 as in FIGS. 8–10. During the subsequent folding of the sheet $W_1$ into the signature $W_2$ on the jaw cylinder 3, too, the sheet will stay engaged between movable jaw and fixed jaw against the risk of accidental disengagement and consequent failure in folding.

A further pronounced feature of the illustrated embodiment is that the individual inserted parts 21 of the folding blade in the cavity are caught between fixed jaw indentations 17 and movable jaw indentations 19. The insert parts of the folding blade in the cavity are therefore easy of withdrawal from between the pair of jaws 11 and 13, there being no concurrent joint withdrawal of the sheet $W_1$ when the insert parts of the folding blade in the cavity are withdraw from between the pair of jaws 11 and 13.

As has been stated with reference to FIG. 1, the jaw cylinder 3 has five cavities 10 at constant circumferential spacings. Two signatures $W_2$ are shown completed on the jaw cylinder 3 and being carried according to the rotation of the jaw cylinder, still engaged by the pairs of jaws 11 and 13. Another sheet $W_1$ is shown just ready to be inserted in the third cavity 10 in the jaw cylinder 3. From this third cavity position each signature $W_2$ is to be carried approximately three fifths of one complete revolution of the jaw cylinder 3, to a position in which the signature is released from between the pair of jaws 11 and 13 to be dropped onto an appropriate delivery, not shown, which falls outside the scope of this invention.

Notwithstanding the foregoing detailed disclosure it is not desired that the present invention be limited by the exact showing of the drawings or by the description thereof. For example, while the indentations 17 in the fixed jaw 11 are an essential feature of the invention, the indentations 19 in the movable jaw 13 are not. No significant inconvenience will occur in the absence of the indentations 19 from the movable jaw 13, perhaps except for the fact that the insert parts 21 of the folding blade in the cavity will be harder to withdraw from between the pair of jaws 11 and 13. But this trouble is easy to be alleviated or eliminated by making the indentations 17 in the fixed jaw 11 deeper than in the presence of the movable jaw indentations 19.

As another possible modification of the illustrated embodiment, the fixed jaw 11 may be the upstream side wall, instead of the downstream one, of each cavity 10 in the jaw cylinder 3 with respect to its rotational direction. No trouble has proved to occur if each sheet is engaged between the upstream side wall and the movable jaw. It will also be apparent that the circumferences of the cutting cylinder 1, folding cylinder 2, and jaw cylinder 3 need not necessarily be in the ratio of 2:5:5. Various other modifications, alterations and adaptations of the illustrated embodiment may be resorted to in a manner limited only by a just interpretation of the claims which follow.

What is claimed is:

1. In a web-fed rotary press, a mechanism for cutting a continuous web of paper into discrete sheets and folding the successive sheets in the middle into the form of signatures, comprising:

(A) a cutting cylinder capable of rotation in a first direction, the cutting cylinder comprising:
  (a) a cutting blade;

(B) a folding cylinder held opposite the cutting cylinder for rotation in a second direction opposite to the first direction, the folding cylinder comprising:
  (a) means for engaging the web of paper for causing the same to enwrap the folding cylinder with the rotation thereof in the second direction;
  (b) a counter cutting means in the folding cylinder for receiving the cutting blade on the cutting cylinder in order to have the web of paper thereby severed successively into sheets with the rotation of the cutting cylinder and the folding cylinder in the opposite directions; and
  (c) a folding blade arranged parallel to the axis of the folding cylinder and including a plurality of projecting parts spaced apart from one another along the folding blade for travel radially of the folding cylinder in order to push each sheet off the surface of the folding cylinder in the middle of the sheet; and (C) a jaw cylinder held opposite the folding cylinder for rotation in the first direction, the jaw cylinder comprising:
  (a) a cavity including a fixed jaw, the cavity extending parallel to the axis of the jaw cylinder and having an opening in a surface of the jaw cylinder for receiving the folding blade on the folding cylinder together with the sheet being pushed thereby; and
  (b) a movable jaw arranged in the cavity for movement toward and away from the fixed jaw in order to crease the sheet that has been pushed into the cavity by the folding blade on the folding cylinder, by catching the sheet between the jaws;
  (c) the fixed jaw formed with a plurality of indentations so that a respective one of the indentations is arranged in an opposed relationship relative to a respective one of the projecting parts of the folding blade in the cavity as the folding blade is inserted in the cavity.

2. The culling and folding mechanism of claim 1 wherein each one of the plurality of indentations has an indentation width, each one of the plurality of projecting parts has a projecting part width, the indentation width of each one of the indentations in the fixed jaw of the jaw cylinder extending in a direction parallel to the axis of the jaw cylinder is greater than the projecting part width of each one of the projecting parts of the folding blade on the folding cylinder to be inserted in the cavity in the same direction.

3. The cutting and folding mechanism of claim 1 wherein the movable jaw of the jaw cylinder has a plurality of movable jaw indentations formed in its surface opposite the fixed jaw so respective ones of the plurality of movable jaw indentations are in an opposed relationship to the respective ones of the projecting parts of the folding blade in the cavity as the folding blade is inserted in the cavity.

4. The cutting and folding mechanism of claim 3 wherein each one of the plurality of movable jaw indentations has a movable jaw indentation width, each one of the plurality of projecting parts has a projecting part width, the movable jaw indentation width of each one of the movable jaw indentations in the movable jaw of the jaw cylinder in a direction parallel to the axis of the jaw cylinder is greater than the projecting part width of each one of the projecting parts of the folding blade on the folding cylinder to be inserted in the cavity in the same direction.

5. A folding mechanism for folding sheets in the middle into the form of signatures, comprising:

(A) a folding cylinder comprising:

(a) means for engaging the sheet for causing the same to enwrap the folding cylinder with the rotation thereof in the second direction; and (b) a folding blade arranged parallel to the axis of the folding cylinder and including a plurality of projecting parts spaced apart from one another along the folding blade for travel radially of the folding cylinder in order to push each sheet off the surface of the folding cylinder in the middle of the sheet; and (B) a jaw cylinder held opposite the folding cylinder, the jaw cylinder comprising:

(a) a cavity including a fixed jaw, the cavity extending parallel to the axis of the jaw cylinder and having an opening in a surface of the jaw cylinder for receiving the folding blade on the folding cylinder together with the sheet being pushed thereby; and (b) a movable jaw arranged in the cavity for movement toward and away from the fixed jaw in order to crease the sheet that has been pushed into the cavity by the folding blade on the folding cylinder, by catching the sheet between the jaws;

(c) the fixed jaw formed with a plurality of indentations so that a respective one of the indentations is arranged in an opposed relationship relative to a respective one of the projecting parts of the folding blade in the cavity as the folding blade is inserted in the cavity.

6. The folding mechanism of claim 5 wherein each one of the plurality of indentations has an indentation width, each one of the plurality of projecting parts has a projecting part width, the indentation width of each one of the indentations in the fixed jaw of the jaw cylinder extending in a direction parallel to the axis of the jaw cylinder is greater than the projecting part width of each one of the projecting parts of the folding blade on the folding cylinder to be inserted in the cavity in the same direction.

7. The folding mechanism of claim 5 wherein the movable jaw of the jaw cylinder has a plurality of movable jaw indentations formed in its surface opposite the fixed jaw so respective ones of the plurality of movable jaw indentations are in an opposed relationship to the respective ones of the projecting parts of the folding blade in the cavity as the folding blade is inserted in the cavity.

8. The folding mechanism of claim 7 wherein each one of the plurality of movable jaw indentations has a movable jaw indentation width, each one of the plurality of projecting parts has a projecting part width, the movable jaw indentation width of each one of the movable jaw indentations in the movable jaw of the jaw cylinder in a direction parallel to the axis of the jaw cylinder is greater than the projecting part width of each one of the projecting parts of the folding blade on the folding cylinder to be inserted in the cavity in the same direction.

* * * * *